US008833462B2

(12) United States Patent
Muise et al.

(10) Patent No.: US 8,833,462 B2
(45) Date of Patent: Sep. 16, 2014

(54) METHOD AND SYSTEM FOR INSTALLING SUBSEA WELL TREES

(71) Applicants: Jason Muise, St. John's (CA); Andrew J. Blundon, Paradise (CA)

(72) Inventors: Jason Muise, St. John's (CA); Andrew J. Blundon, Paradise (CA)

(73) Assignee: Technip France, Courbevoie (FR)

( * ) Notice: Subject to any disclaimer, the term of this patent is extended or adjusted under 35 U.S.C. 154(b) by 79 days.

(21) Appl. No.: 13/621,463

(22) Filed: Sep. 17, 2012

(65) Prior Publication Data

US 2014/0076574 A1 Mar. 20, 2014

(51) Int. Cl.
*E21B 7/128* (2006.01)

(52) U.S. Cl.
USPC ..... 166/352; 166/358; 166/366; 175/7; 405/203

(58) Field of Classification Search
CPC ..... E21B 7/128
USPC ..... 166/339, 351–354, 358, 366, 368; 114/264–266; 175/7, 9; 405/195.1, 405/203, 205, 207, 208, 223.1, 224, 227
See application file for complete search history.

(56) References Cited

U.S. PATENT DOCUMENTS 2,747,840 A * 5/1956 Miles ..... 175/9
3,063,500 A * 11/1962 Logan ..... 166/351
3,572,044 A * 3/1971 Pogonowski ..... 405/204
3,592,263 A * 7/1971 Nelson ..... 166/356
3,703,207 A * 11/1972 Horton ..... 166/337
4,038,830 A * 8/1977 Sumner ..... 405/208
4,283,159 A * 8/1981 Johnson et al. ..... 405/60
4,512,684 A * 4/1985 Hale et al. ..... 405/217
4,558,744 A * 12/1985 Gibb ..... 166/335
4,576,518 A * 3/1986 Cooke et al. ..... 405/205
4,695,201 A * 9/1987 Beskow et al. ..... 405/224.1
4,755,082 A * 7/1988 Beskow et al. ..... 405/217
5,292,207 A * 3/1994 Scott ..... 405/207
5,310,286 A * 5/1994 Gilbert et al. ..... 405/169
5,697,446 A * 12/1997 Giannesini ..... 166/354
6,113,314 A * 9/2000 Campbell ..... 405/224
2010/0221069 A1* 9/2010 Brinkmann et al. ..... 405/203
2011/0168402 A1* 7/2011 Nadarajah et al. ..... 166/365

* cited by examiner

*Primary Examiner* — Matthew Buck
(74) *Attorney, Agent, or Firm* — Locke Lord LLP

(57) ABSTRACT

The disclosure provides a method and system of installing subsea well trees, comprising: creating a glory hole having a depth below a seabed at a well location of a hydrocarbon reservoir; moving a floating offshore platform coupled with a foundation, the platform having a topsides and a caisson with downwardly extending walls defining an inner volume between the walls, the foundation coupled to the caisson walls, and the caisson walls having adjustable buoyancy; lowering the offshore platform with the foundation into the glory hole; drilling from the topsides into the hydrocarbon reservoir below the foundation to create a well; installing a well tree on the well, the well tree being disposed in the glory hole below the height of the seabed; coupling the well tree to a flow line; releasing the offshore platform from the foundation; and reusing the offshore platform to install other foundations at other predetermined well locations.

9 Claims, 8 Drawing Sheets

METHOD AND SYSTEM FOR INSTALLING SUBSEA WELL TREES

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates generally to fluid end manifolds for pumps and more specifically to modular fluid ends of high-pressure pumps having multiple chambers.

2. Description of the Related Art

The hydrocarbon production industry generally uses subsea well trees to flow subsea hydrocarbon well fluids in a hydrocarbon production field to a remote site from the seabed. The remote site can be a production platform, such as a floating production, storage and offloading (FPSO) vessel, a tension leg platform (TLP), semi-submersible platform, a Spar platform, or other platforms, as well as through a subsea flow line to a nearby surface installation, and other types of facilities. The subsea well tree typically connects with detachable couplings through risers to the appropriate vessel, platform or other remote site. In some installations, several well trees from different locations in the field can be linked to a central collection area to produce the fluid to the remote site.

In artic and other non-temperate environments, installations take special measures to protect the platforms installed over the production fields. The measures generally allow the platform to be disconnected from the well trees temporarily to allow the passage of icebergs, ice flows, storms and other potentially hazardous weather conditions, and then reconnect to the well trees after the hazard passes. An FPSO can be disconnected from the well trees as well.

For example, U.S. Pat. No. 4,576,518 shows a platform for use in combination with a foundation affixable to a seabed to provide a fixed/movable marine structure system. The platform is capable of alternately existing in a fixed mode in which the platform is releasably coupled to the foundation, and in a floating mode in which the platform is uncoupled from the foundation. Such locations include areas subject to severe weather conditions and periodic intrusion of icebergs or ice floes. The patent indicates that the platform is intended for a particular site with the foundation and returns to the same foundation after the danger has passed so that production of the field can resume. The platform remains associated with the particular field as long as production continues, and then may be moved after production has ceased from the particular field.

U.S. Pat. No. 6,113,314 shows another example of a releasable platform due to icebergs and other potentially damaging conditions. A quick connect/disconnect system for an offshore oil/gas production platform is facilitated by a submerged connection header for the platform. The platform comprises a vessel with a lower connection bay. The vessel has the ability to be ballasted to position the connection bay either for connection or for transport toward and away from the connection header. The connection header houses the production lines and control lines and is positively buoyed and held in place by tension cables extending from the header bottom to the ocean floor. Upon the approach of icebergs and other hazardous conditions, the platform can be disconnected from the connection header, moved, and then returned to the connection header after the hazard to resume production.

It would be desirable to install well trees with a foundation and removable platform in a manner that protects the well trees in hazardous environments and improves over the state of the art for platform utilization.

BRIEF SUMMARY OF THE INVENTION

The disclosure provides a method and system for installing a foundation, drilling wells with a removable platform to install one or more wells trees, and removing the platform leaving the well trees protected, while the platform is reused for installations of other foundations and other well trees at other locations.

The disclosure provides a method and system of installing subsea well trees, comprising: creating a glory hole having a depth below a seabed at a well location of a hydrocarbon reservoir; moving a floating offshore platform coupled with a foundation, the platform having a topsides and a caisson with downwardly extending walls defining an inner volume between the walls, the foundation coupled to the caisson walls, and the caisson walls having adjustable buoyancy; lowering the offshore platform with the foundation into the glory hole; drilling from the topsides into the hydrocarbon reservoir below the foundation to create a well; installing a well tree on the well, the well tree being disposed in the glory hole below the height of the seabed; coupling the well tree to a flow line; releasing the offshore platform from the foundation; and reusing the offshore platform to install other foundations at other predetermined well locations.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with alphabetical suffixes ("A", "B", and so forth) to designate various similar aspects of the system or device. When referring generally to such elements, the number without the letter may be used. Further, such designations do not limit the number of elements that can be used for that function.

Figure 1:
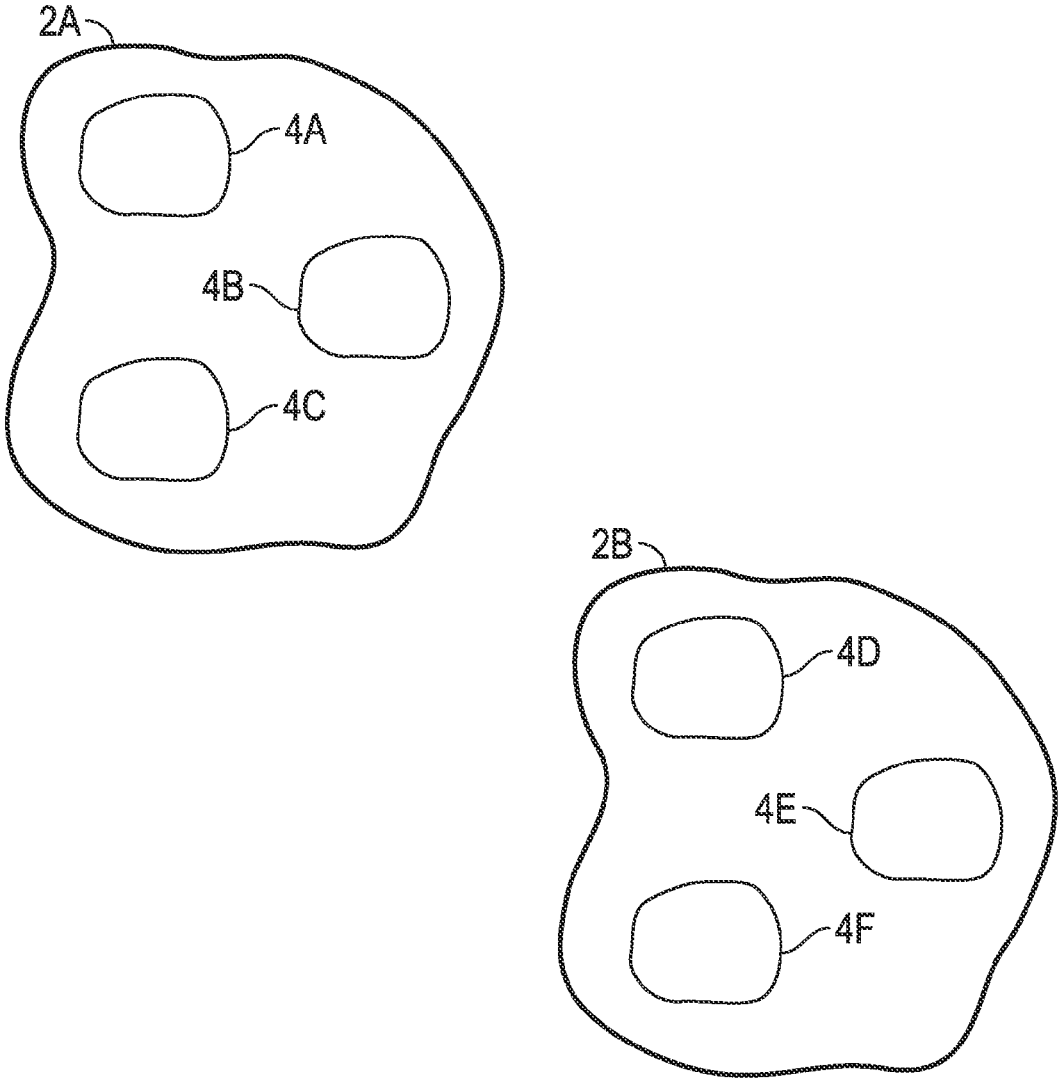
FIG. 1 is a top schematic view of a plurality of exemplary hydrocarbon fields with proposed well locations for producing hydrocarbons from the fields.

FIG. 1 is a top schematic view of a plurality of exemplary hydrocarbon fields with proposed well locations for producing hydrocarbons from the fields. The hydrocarbon field 2A can be of various shapes and depths and dimensions. Preliminary studies may show a desire to locate one or more wells in a well location 4A (generally, 4). Distal from the well location 4A but within the hydrocarbon field 2A (generally, 2), other well locations, such as well locations 4B, 4C and others can be located. Similarly, a separate hydrocarbon field 2B can include one or more well locations 4D, 4E, 4F that will be used to produce hydrocarbons from the hydrocarbon field. Other well locations and/or other hydrocarbon fields can be pursued.

Figure 2:
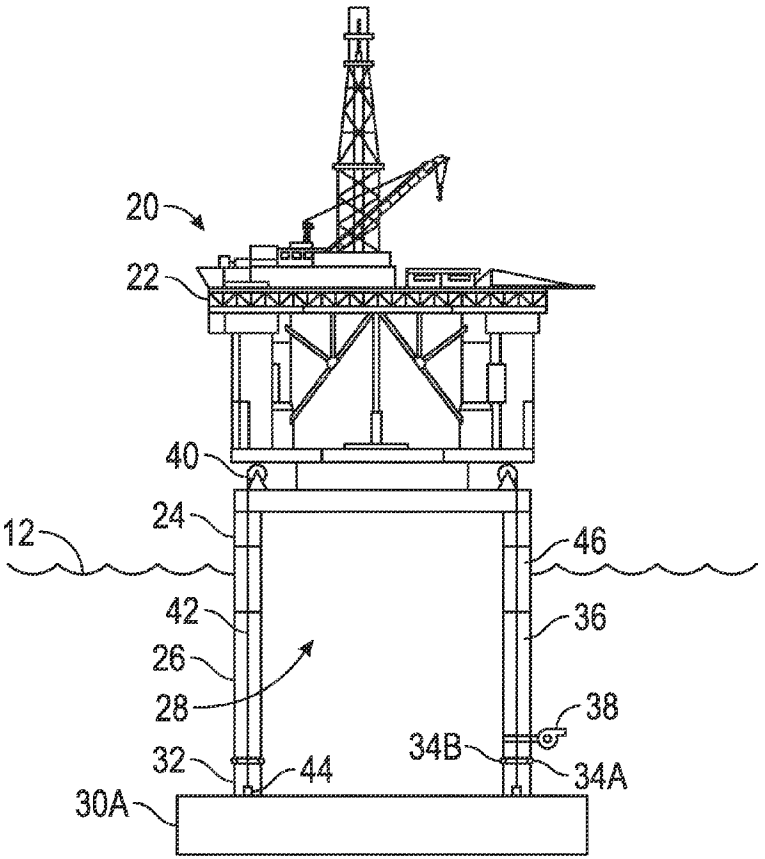
FIG. 2 is a perspective schematic view of an exemplary system according to the invention.

FIG. 2 is a perspective schematic view of an exemplary system according to the invention. The system generally includes an offshore platform 20 that is coupled to a foundation 30A and can be used to help install well trees on the seabed. The platform can be a gravity base structure (GBS) but yet can be controlled in its buoyancy, or other platform structure as may be suitable for the installation. Generally, the offshore platform will include a topsides 22, known in the industry to provide support services, production facilities, housing requirements, and other portions of a platform used in drilling of a hydrocarbon field and can include a variety of configurations, such as, but without limitation, the exemplary one shown. The topsides 22 is coupled to a caisson 24 that includes a top and walls 26 that protrude downwardly. The perimeter of the caisson 24 can be any geometrical shape, including circular, elliptical, square, rectangular, octagonal, and so forth. An interior volume 36 of the caisson walls 26 can include one or more buoyancy chambers 46 and are generally controlled for buoyancy. An inner volume 28 of the caisson walls is formed and in at least one embodiment may be a dry environment to facilitate installation of well trees and drilling operations below the water line 12. The caisson walls 26 extend downward toward a foundation 30A (generally, 30). The foundation 30A can be made of a variety of materials including concrete, steel, or other materials. In general, the foundation will have a substantial weight, and therefore, if the foundation is made of steel, generally after placement, the foundation will be filled with concrete in at least a portion of the steel chambers of the foundation. In at least one embodiment, the foundation itself includes a short stub wall 32A (generally, 32) that extends upwardly from the foundation and engages the downward extending caisson walls 26. One or more seals 34 can be installed between the caisson walls 26 and the stub walls 32A at the interface between the walls. The seals assist in keeping water out of the inner volume 28 when the inner volume is desired to be dry. A pump 38 can be coupled to the platform 20 or the foundation 30A. At least one pump 38 can be coupled to the caisson walls 26 in at least one embodiment. The pump 38 is generally used to evacuate the inner volume 28 from water and other fluids at various steps in the process, as described below.

The foundation 30A is releasably coupled to the offshore platform 20. Specifically, the foundation 30A and, if applicable, the stub walls 32A can be releasably coupled to the caisson walls 26. In at least one embodiment, a tensioner 40 can be used to pull a link 42 that is releasably coupled to a coupler 44 on the foundation (or stub walls). For example, the tensioner 40 can be a winch, hydraulic cylinder, rack and pinion drive, or other actuator. The link 42 can be a chain, cable, rod, or other connecting element. The releasable coupler 44 can be a link, ring, anchor, or other structure that can at least temporarily attach the link 42 to the foundation 30A or stub wall 32A. The tensioner 40 can pull or otherwise actuate the link 42 to create tension on the coupler 44 and hence the foundation 30A. To release the foundation from the caisson walls 26, the tensioner can release the tension on the link and allow the foundation to separate from the caisson walls 26.

The following sequence is an exemplary sequence of a method of using the system and not to be restrictive of the scope of the invention which is limited only by the claims.

Figure 3:
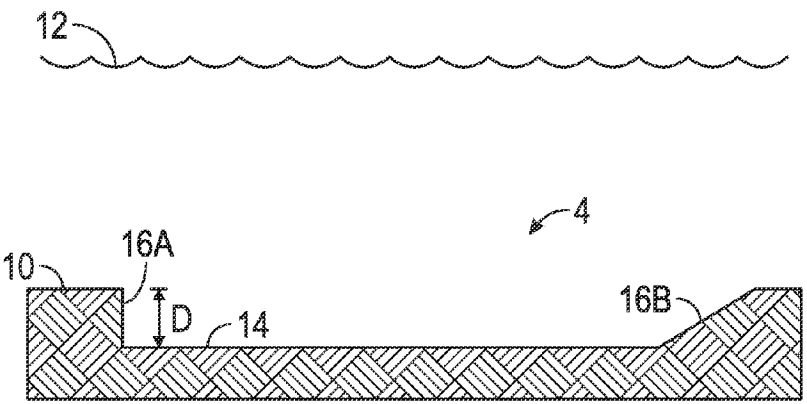
FIG. 3 is a side schematic view of a proposed well location in the hydrocarbon field with seabed preparations for a hole to receive a foundation.

FIG. 3 is a side schematic view of a proposed well location in the hydrocarbon field with seabed preparations for a hole to receive a foundation. It is generally desirable to create an excavation in the seabed 10 in which the foundation and well trees can be installed, so as to protect the well trees below the surface of the seabed. For example, a large iceberg floating by the seabed 10 could damage the well trees if the well trees extended above the seabed. A recessed installation can help protect the well trees. Thus, a glory hole 14 (as a term that is generally used in the industry) is created by trenching out or otherwise excavating a portion of the seabed 10 to the depth D, so that the excavation is below the surface of the seabed 10. The glory hole 14 can be in any shape or size and generally will have sides 16A, 16B (generally 16) of various shapes. The excavation or the glory hole 14 is created at the desired well location 4, such as those shown in FIG. 1.

Figure 4:
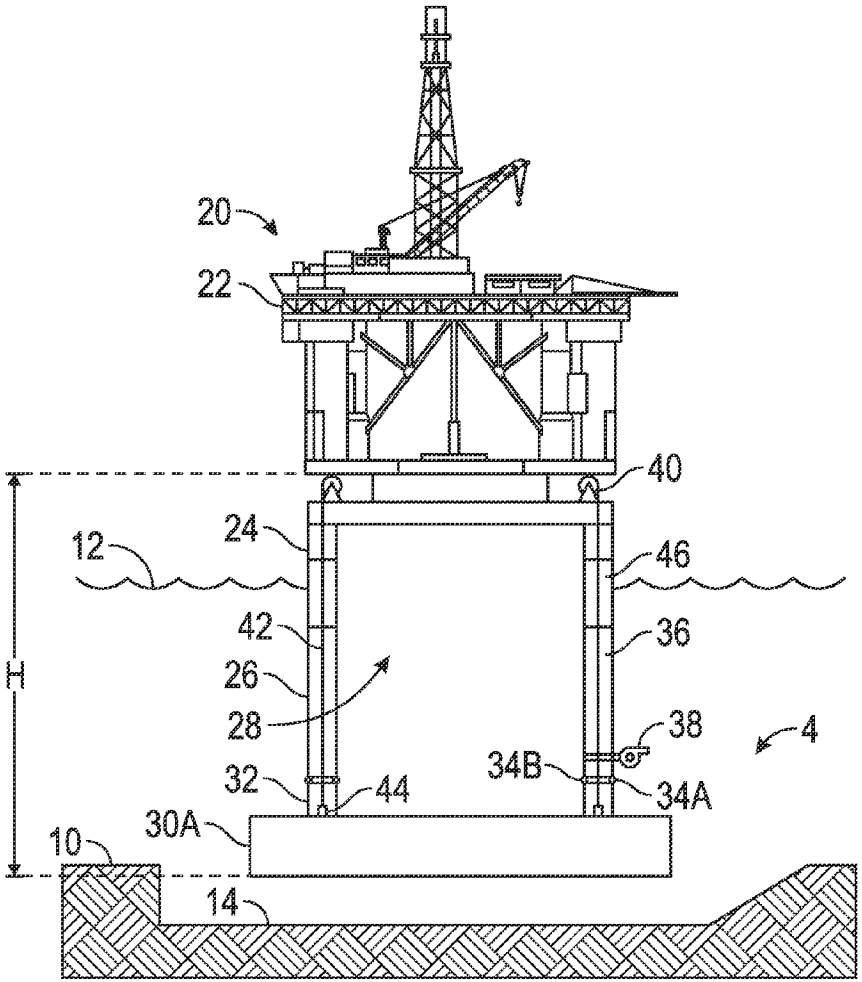
FIG. 4 is a side schematic view of an offshore platform coupled with a foundation for delivery and installation at the well location.

FIG. 4 is a side schematic view of an offshore platform coupled with a foundation for delivery and installation at the well location. The offshore platform 20 with the foundation 30A coupled thereto can be moved in location above the glory hole 14 of the well location 4. As described above, the caisson walls 26 can be sealingly coupled to the stub walls 26 extending upward from the foundation 30A. The tensioner 40 has generally been actuated with a link 42 attached to a coupler 44 on the foundation to pull or otherwise actuate the foundation 30A and the stub walls 32A into sealing engagement with the caisson walls 26. The topsides 22 is generally located above the water line 12, so that the height H of the platform as measured from under the topsides 22 to the bottom of the foundation 30A is greater than the distance from the bottom of the glory hole 14 to the water line 12. Further, the inner volume 28 formed interior to the caisson walls 26, stub walls 32A and above the foundation 30A can be dry due to the sealing engagement of the caisson walls 26 with the stub walls 32A. The foundation 30A can also include buoyancy tanks that can be controlled as an optional embodiment in addition to the buoyancy capabilities of the caisson 24.

Figure 5:
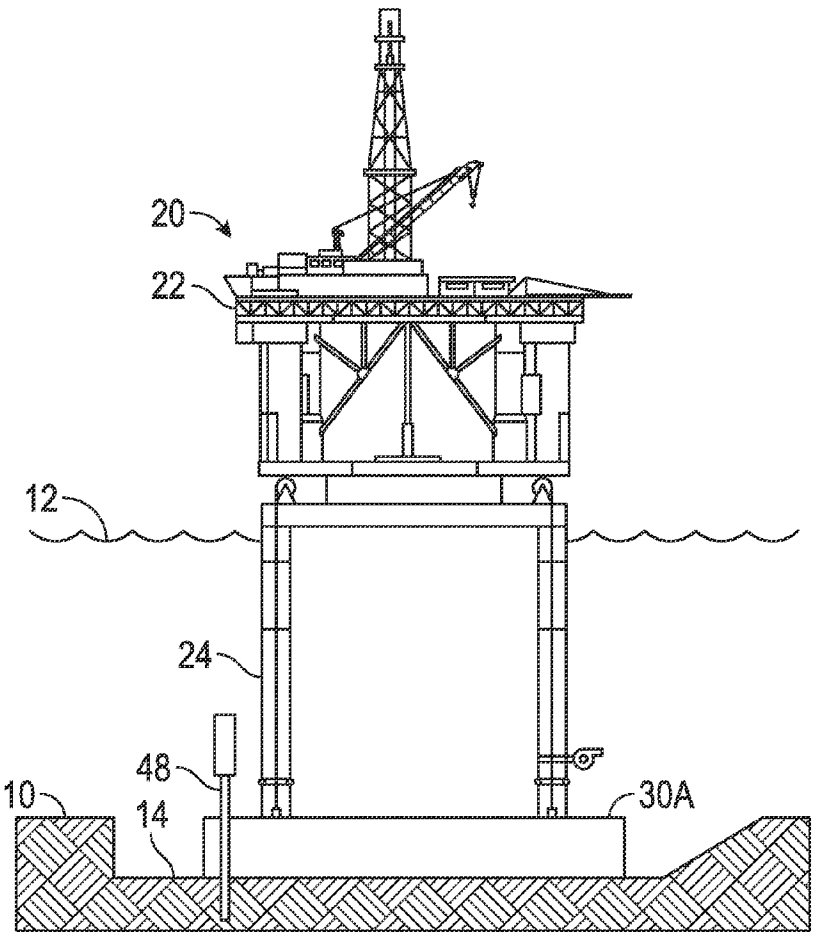
FIG. 5 is a side schematic view of the offshore platform with the foundation installed in the hole in the seabed.

FIG. 5 is a side schematic view of the offshore platform with the foundation installed in the hole in the seabed. The platform 20 can be ballasted, so that the foundation 30A is lowered into the glory hole 14 with the topsides 22 being above the water line 12. Optionally, the foundation 30A can be anchored to the seabed 10 in the glory hole 14 with one or more piles 48 installed according to conventional methods.

Figure 6:
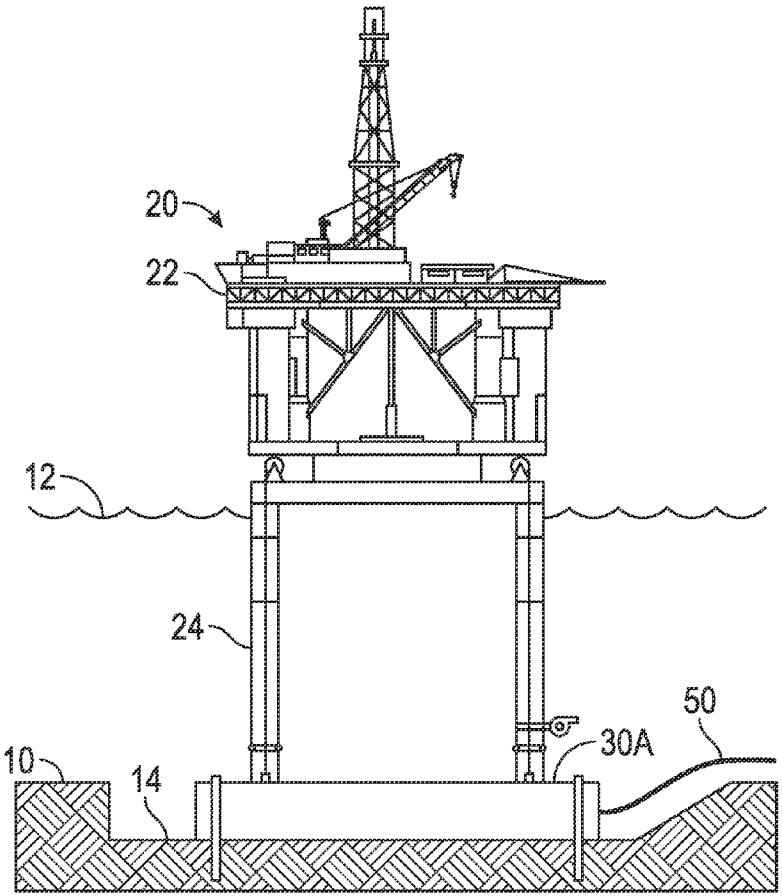
FIG. 6 is a side schematic view of the offshore platform with the foundation and a flow line coupled to the foundation.

FIG. 6 is a side schematic view of the offshore platform with the foundation and a flow line coupled to the foundation. A flow line 50 can be coupled to the foundation 30A generally once the foundation is secured in place to avoid movement and stress on the flow line. In other embodiments, a flexible flow line can be installed prior to securing the foundation in place.

Figure 7:
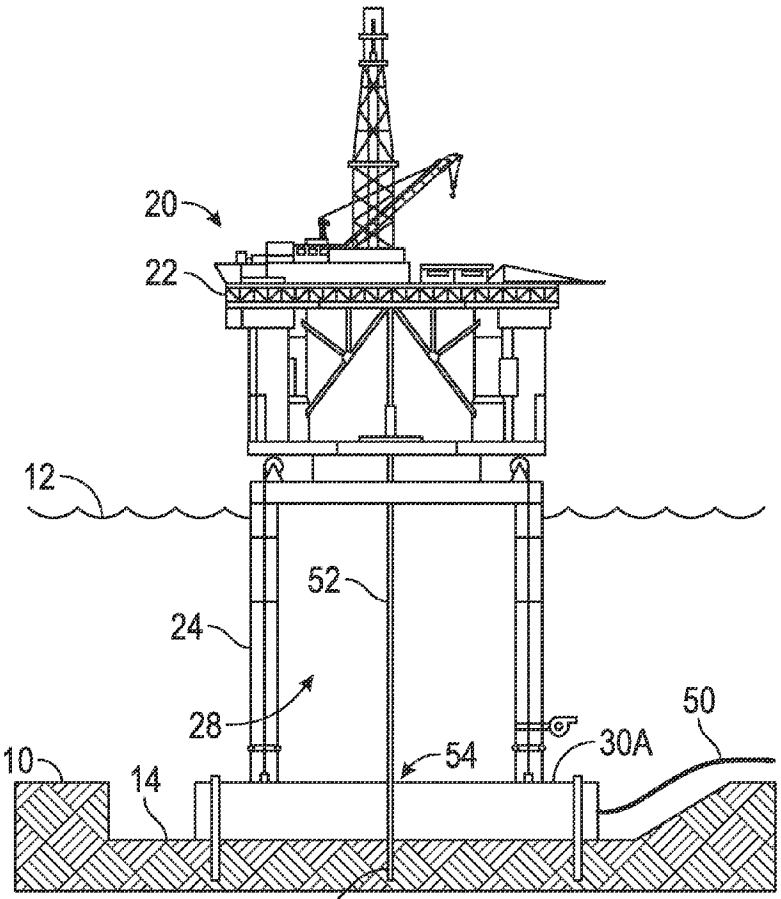
FIG. 7 is a side schematic view of a drilling operation from the offshore platform through the foundation for a well.

FIG. 7 is a side schematic view of a drilling operation from the offshore platform through the foundation for a well. Drilling operations from the topsides 22 include creating a drill string 52 that can drill through a well opening 54 in the foundation to create a well 56. The volume 28 can be dry and can facilitate drilling operations without water currents and other external hydraulic forces, as well as, access at the foundation level during operations as required.

Figure 8:
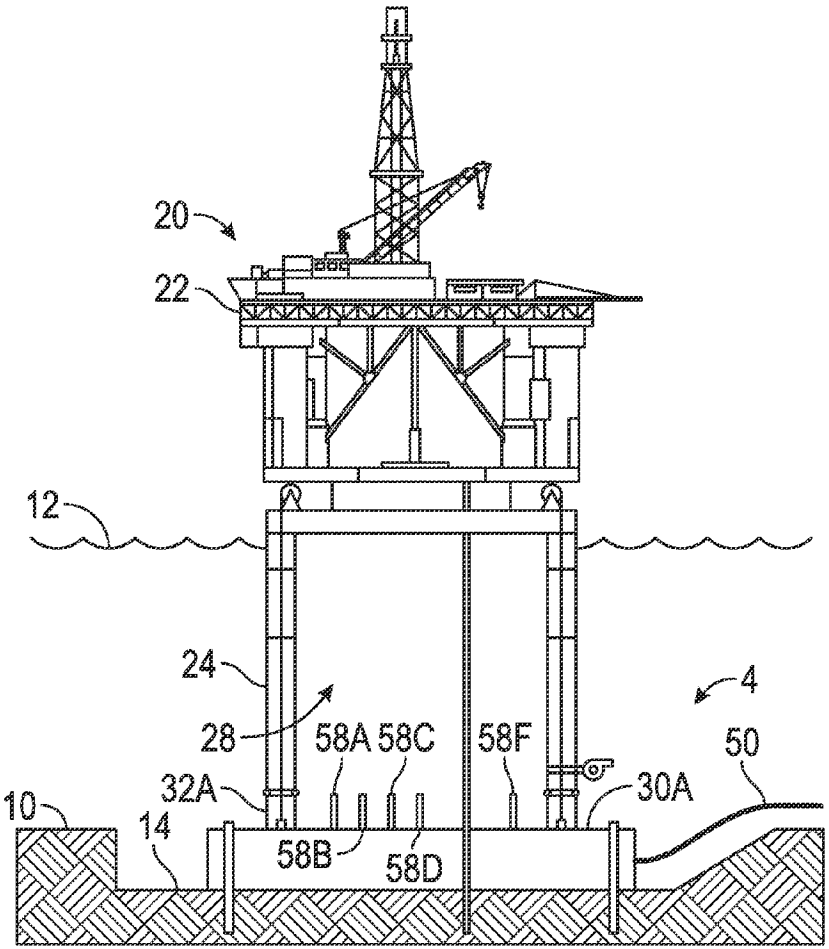
FIG. 8 is a side schematic view of a drilling operation from the offshore platform through the foundation for additional wells and having well trees installed for completed wells.

FIG. 8 is a side schematic view of a drilling operation from the offshore platform through the foundation for additional wells and having well trees installed for completed wells. Once the drilling is completed on a well, various procedures including installing a well tree 58A (generally, 58) are conducted to complete the well and bring it into a production capability. Additional wells can be drilled in like manner so that a number of wells at the particular well location 4 can be used to produce hydrocarbons from the underlying hydrocarbon field 2 shown in FIG. 1 for the particular well location 4. Thus, a number of well trees 58A, 58B, 58C, 58D, and so forth, can be installed through the foundation 30A at the given well location 4. The well trees can be fluidically coupled to the flow line 50. In the embodiments in which the flow line is coupled to the foundation, the well trees can be coupled to the flow line through the foundation. Advantageously, the flow line is disposed at a lower elevation to help protect the flow line from hazards at higher elevation, such as floating icebergs and the like. In other embodiments, the flow line can pass through the stub walls 32A or even above the stub walls to connect to the well tree 58.

Figure 9:
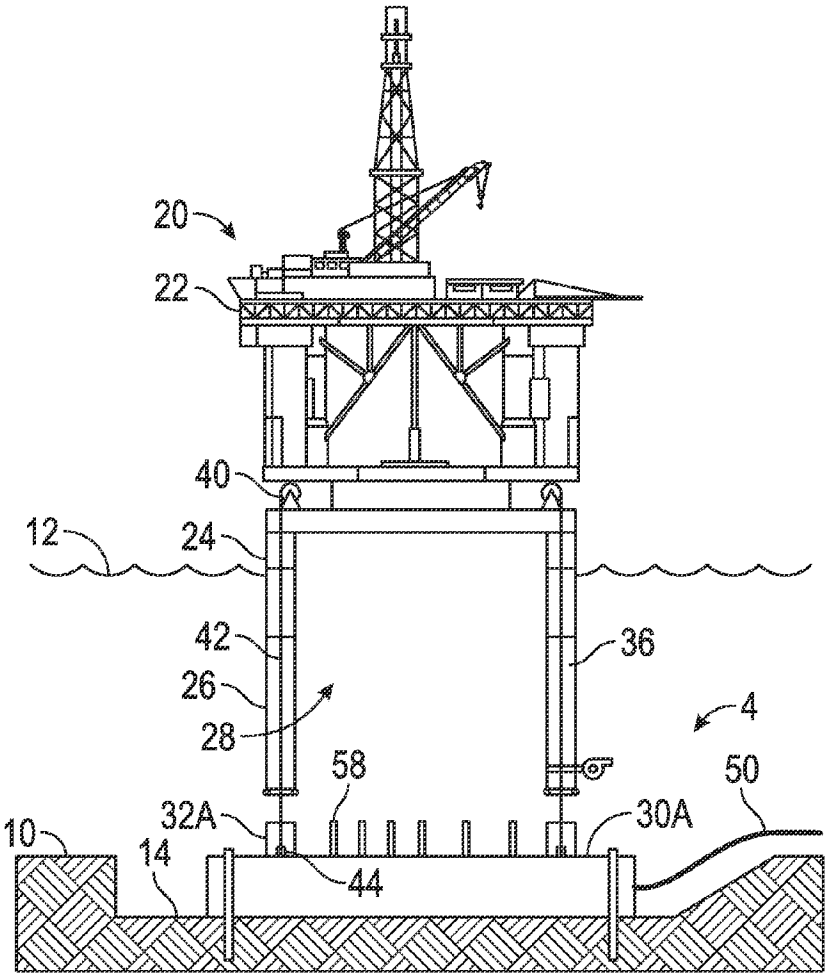
FIG. 9 is a side schematic view of the offshore platform being decoupled from the foundation after drilling operations are completed and well trees installed.

FIG. 9 is a side schematic view of the offshore platform being decoupled from the foundation after drilling operations are completed and well trees installed. Once the wells have been drilled and well trees installed, the platform 20 can be disconnected from the foundation 30A. In at least one embodiment, the tensioner 40 can release tension on the foundation 30 by releasing tension on the linkage 42 that is coupled to the coupler 44. The interface between the stub walls 32A and caisson walls 26 is opened so that the seals 34, if applicable, are no longer sealing. Water therefore would come into the inner volume 28 as a caisson walls. The interior volume 36 of the caisson walls can be deballasted to raise the offshore platform 20. At some point, the linkage 42 is released from the coupler 44, so that the offshore platform 20 can completely disconnect from the foundation 30A.

Figure 10:
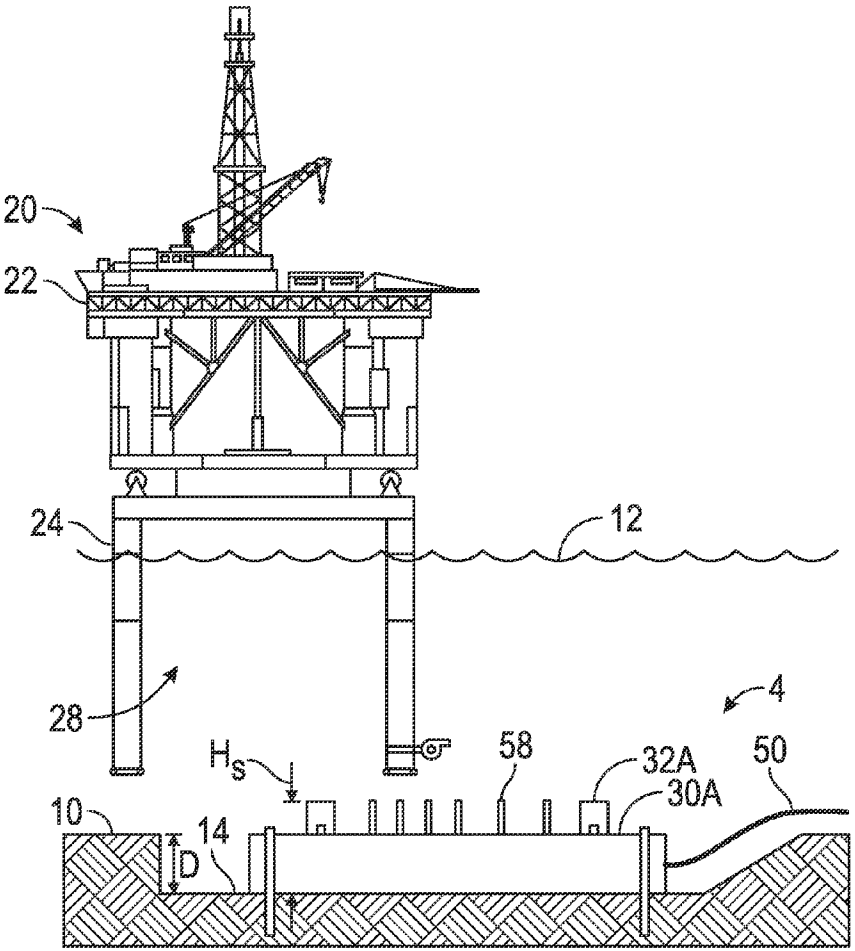
FIG. 10 is a side schematic view of the offshore platform being removed from the well location leaving the foundation and well trees for production through the flow line.

FIG. 10 is a side schematic view of the offshore platform being removed from the well location leaving the foundation and well trees for production through the flow line. Once the offshore platform 20 is cleared and released from the foundation 30A and stub walls 32, if applicable, the offshore platform can be relocated and reused to install another foundation as described below. The foundation 30A with the stub walls 32A remains at the well location 40. In at least one embodiment, optionally the stub walls 32A can have a height Hs above the foundation 30A that allows the stub walls to protrude above the depth D of glory hole 14 to further provide protection from hazards, such as floating icebergs, ice flows, and other hazards that might damage the well trees 58.

Figure 11:
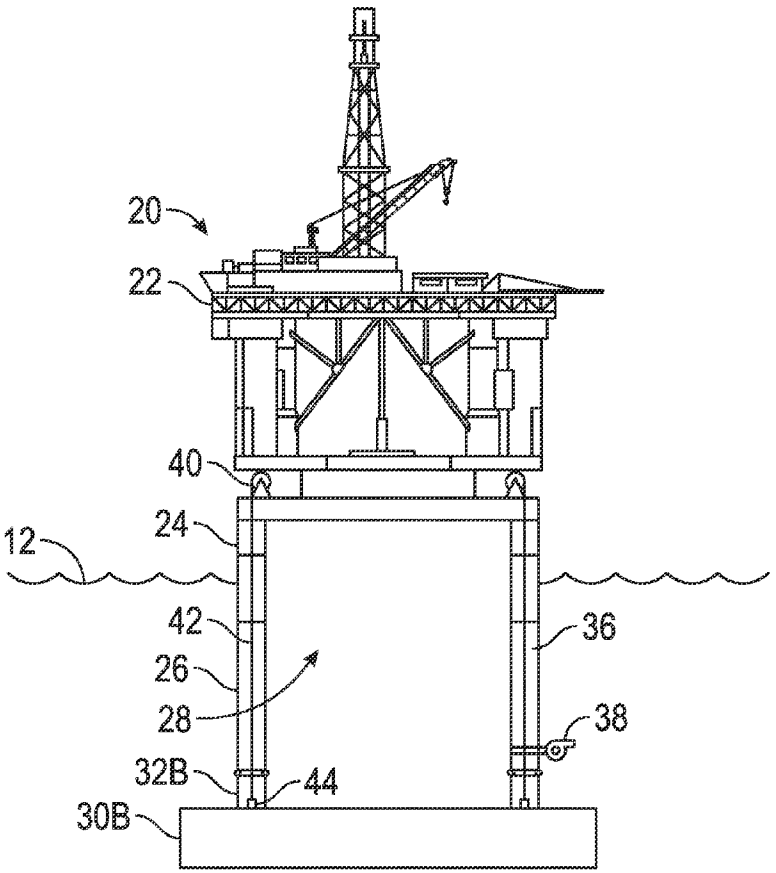
FIG. 11 is a side schematic view of an offshore platform coupled with another foundation for delivery and installation at another well location.

FIG. 11 is a side schematic view of an offshore platform coupled with another foundation for delivery and installation at another well location. The offshore platform 20 can be moved to a new location to retrieve another foundation 30B for another well location 4. The platform 20 is coupled to a new foundation 30B and if applicable new stub walls 32B, the foundation 30B and stub walls 32B represent another foundation that can be installed at another well location at the same hydrocarbon field 2A or another hydrocarbon field 2B, such as shown in FIG. 1. The offshore platform can be maneuvered into a location that has the new foundation 30B. The linkage of the topsides can be lowered into proximity with the foundation 30B. The tensioner 40 can release the link 42 to allow it to be coupled to the coupler 44 on the foundation 30B or stub walls 32B. The tensioner 40 can pull or actuate the foundation into sealing engagement to the caisson walls 26. The pump 36 can evacuate the inner volume 28 of the caisson 24 to create a dry chamber for operations as described herein. The topsides 22, caisson 24, and in general the platform 20, with the new foundation 30B can be moved to another well location, such as 4B, 4C of the hydrocarbon field 2A or another hydrocarbon field 2B having its own well locations, such as well locations 4D, 4E, 4F. Once on location, the process can be repeated with the glory hole and installation of the foundation and well trees in the glory hole until the full amount of foundations and well trees for the various desired well locations can be completed.

Figure 12:
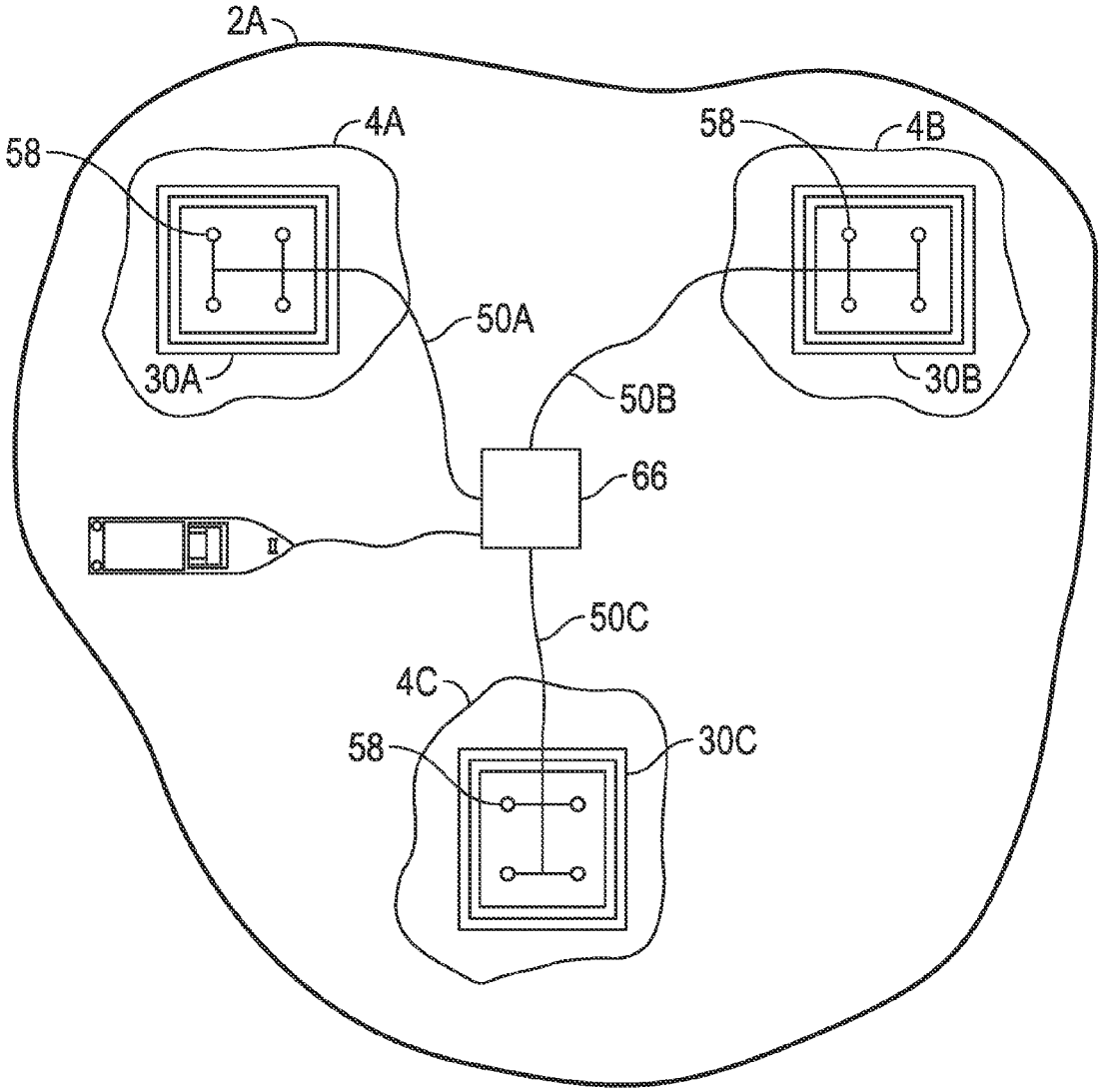
FIG. 12 is a top schematic view of an exemplary hydrocarbon field with a plurality of installed foundations and well trees in the well locations connected through a flow line to a collector.

FIG. 12 is a top schematic view of an exemplary hydrocarbon field with a plurality of installed foundations and well trees in the well locations connected through a flow line to a collector. In at least one embodiment, the hydrocarbon field 2A described in FIG. 1, is shown completed. A foundation 30A is located at well location 4A and includes plurality of well trees 58 that are fluidically coupled to a flow line 50A. The flow line 50A can be coupled to a collector 66. Similarly, the well location 4B now shows a foundation 30B installed thereon with the plurality of well trees 58 coupled to a flow line 50B that also is fluidically connected to the collector 66. Likewise the well location 4C shows a foundation 30C installed thereon with the plurality of well trees 58 installed on the foundation fluidically coupled to a flow line 50C which is then coupled to the collector 66. In at least one embodiment, an FPSO or other vessel or platform, herein vessel 68, can be fluidicly coupled from the water line 12 down to the collector 66 to recover the production from the various well locations 4 in the hydrocarbon field 2A. If a hazardous condition occurs such as severe weather, icebergs, ice flows and the like, the FPSO can simply disconnect from the collector 66 and move temporarily until the hazard passes. The multiple well locations 4 with the foundations and well trees installed thereon are generally protected from the hazards as described above.

Figure 13:
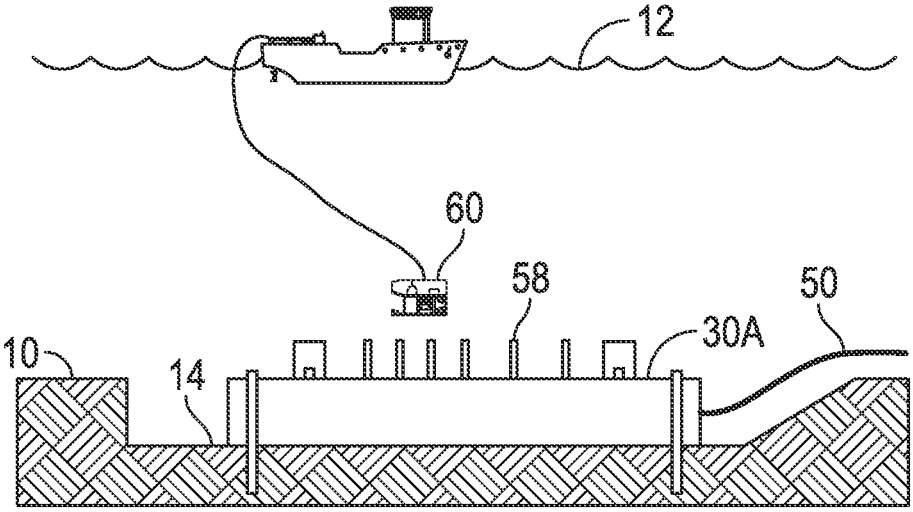
FIG. 13 is a side schematic view of the well trees being capable of service through other vessels than the offshore platform.

FIG. 13 is a side schematic view of the well trees being capable of service through other vessels than the offshore platform. The disclosure provides an added benefit for maintenance purposes. In contrast to a normal installation that includes a production platform on top of the well trees, the present disclosure offers ease of accessibility from the surface to the well trees. Because the offshore platform is not installed with the foundation 30 and the wells trees 58, a service vessel 60 can approach the foundation and well trees and perform needed maintenance through direct access. For instance, the service vessel 60 can lower an ROV for inspection, maintenance, and other service.

Other and further embodiments utilizing one or more aspects of the invention described above can be devised without departing from the spirit of Applicant's invention. For example, the size and shape of the foundations can vary, the size and shape and type of floating offshore platform can vary, the number of well trees on each foundation can vary, and other variations in features that only are limited by the claims.

Further, the various methods and embodiments of the choke valve can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

The invention claimed is:

1. A method of installing subsea well trees, comprising:

creating a glory hole having a depth below a seabed at a predetermined well location of a hydrocarbon reservoir;

moving a floating offshore platform releasably coupled with a foundation, the platform having a topsides and a caisson, the caisson having downwardly extending walls defining an inner volume between the walls and being open at a bottom of the caisson when the caisson is not coupled with the foundation, the foundation being coupled to the caisson walls, and the caisson walls further having adjustable buoyancy;

lowering the offshore platform with the foundation into the glory hole below the seabed;

drilling from the topsides into the hydrocarbon reservoir below the foundation to create a well;

installing at least one well tree on the well, the well tree being disposed in the glory hole below the height of the seabed;

coupling the well tree to a flowline;

releasing the offshore platform from the foundation; and reusing the offshore platform to install an other foundation at an other predetermined well location.

2. The method of claim 1, wherein reusing the offshore platform to install the other foundation comprises coupling to the other foundation with the caisson walls and evacuating fluid from the inner volume between the caisson walls after the coupling.

3. The method of claim 1, wherein the foundation comprises upwardly extending stub walls aligned with the downwardly extending caisson walls and configured to be sealingly engaged with the caisson walls.

4. The method of claim 3, wherein the stub walls have a height above the seabed and further comprising protecting the well heads to an elevation of the height of the stub walls.

5. The method of claim 1, further comprising sealingly engaging the caisson walls with the foundation.

6. The method of claim 5, further comprising evacuating water from the inner volume between the caisson walls when the caisson walls are sealingly engaged with the foundation.

7. The method of claim 1, further comprising a tensioner to coupled the platform and configured to create tension to couple the foundation with the offshore platform during transportation and installation.

8. The method of claim 1, further comprising reusing the offshore platform to install an other foundation at an other predetermined well location of an other hydrocarbon reservoir.

9. The method of claim 1, wherein at least one well tree from a plurality of foundations and well locations are fluidicly coupled to a collector.

* * * * *